US007084726B2

(12) United States Patent
Gupta et al.

(10) Patent No.: US 7,084,726 B2
(45) Date of Patent: Aug. 1, 2006

(54) THIN FILM SHAPE MEMORY ALLOY ACTUATED MICRORELAY

(75) Inventors: Vikas Gupta, San Leandro, CA (US); Valery Martynov, San Francisco, CA (US)

(73) Assignee: TiNi Alloy Company, San Leandro, CA (US)

( * ) Notice: Subject to any disclaimer, the term of this patent is extended or adjusted under 35 U.S.C. 154(b) by 493 days.

(21) Appl. No.: 10/661,035

(22) Filed: Sep. 15, 2003

(65) Prior Publication Data

US 2004/0080239 A1 Apr. 29, 2004

Related U.S. Application Data

(62) Division of application No. 09/821,840, filed on Mar. 28, 2001, now Pat. No. 6,624,730.
(60) Provisional application No. 60/192,766, filed on Mar. 28, 2000.

(51) Int. Cl.
*H01H 51/22* (2006.01)

(52) U.S. Cl. ..... 335/78; 335/73

(58) Field of Classification Search ..... 335/78, 335/83, 128; 257/414, 417, 421, 531; 337/36, 337/54, 70, 298, 333
See application file for complete search history.

(56) References Cited

U.S. PATENT DOCUMENTS 4,243,963 A * 1/1981 Jameel et al. ..... 335/151
5,072,288 A * 12/1991 MacDonald et al. ..... 257/420
5,796,152 A * 8/1998 Carr et al. ..... 257/415
6,407,478 B1 * 6/2002 Wood et al. ..... 310/307

* cited by examiner

*Primary Examiner*—Lincoln Donovan
(74) *Attorney, Agent, or Firm*—Richard E. Backus

(57) ABSTRACT

A microrelay device formed on a silicon substrate wafer for use in opening and closing a current path in a circuit. A pair of electrically conducting latching beams are attached at their proximal ends to terminals on the substrate. Proximal ends of the beams have complementary shapes which releasably fit together to latch the beams and close the circuit. A pair of shape memory alloy actuators are selectively operated to change shapes which bend one of the beams in a direction which latches the distal ends, or bend the other beam to release the distal ends and open the circuit. The microrelay is bistable in its two positions, and power to the actuators is applied only for switching it open or closed.

10 Claims, 6 Drawing Sheets

THIN FILM SHAPE MEMORY ALLOY ACTUATED MICRORELAY

CROSS-REFERENCE TO PRIOR APPLICATIONS

This application claims the benefit under 35 USC §119(e) of U.S. provisional application Ser. No. 60/192,766 filed Mar. 28, 2000 and is a divisional of application Ser. No. 09/821,840 filed Mar. 28, 2001, now U.S. Pat. No. 6,624,730.

STATEMENT OF GOVERNMENT RIGHTS

This invention was made under contract with an agency of the United States Government: Department of the Air Force, Contract No. F29601-98-C-0049, Phase 2.

BACKGROUND OF THE INVENTION

1. Field of the Invention

This invention relates in general to the electrical switching of signals and power in microelectronics circuits.

2. Description of the Related Art

Relays generally use a relatively small electrical current to switch a larger one. Relays usually are operated by electromagnetic solenoids: these are difficult to manufacture in very small size.

Relays are of several kinds. AC, DC, latching and non-latching, multiple or single pole.

Solid state relays exist. In these a voltage controls whether a circuit is conductive or not. These are made as microelectronic components. The disadvantage is that a voltage drop occurs across the component such that it consumes power even when inactive. It works only when electrical voltage is applied.

A relay has two circuits, one that operates the actuator and another that acts as a conductive path for power to be used elsewhere.

A relay requires an actuator, making it different from a switch that may be manually operated. Conventional macroscopic relays use solenoids. Miniature relays use electrostatic, piezoelectric, and thermal actuators. Two types of thermal actuators exist: those based on differential thermal expansion, and those utilizing shape memory alloys. It is known that shape memory alloy actuators have higher work output per unit mass than other actuators.

OBJECTS AND SUMMARY OF THE INVENTION

It is a general object of the invention to provide new and improved devices and methods for switching electrical signals in microelectronics applications.

Other objects of the invention are to make a microrelay that can be microfabricated in arrays, which latches so that power is not consumed most of the time, has near zero insertion loss, conducts relatively large current, and can be manufactured inexpensively in large volume.

Another object is to fill the great demand which exists to switch high currents in excess of 1 ampere.

Another object is to provide MEMS microrelays which can give engineers and designers a new cost-effective option for use in telecommunications, aerospace automated test equipment, and other applications in various emerging markets.

Another object is to provide MEMS microrelays which can be batch fabricated on a silicon wafer using MEMS technology, thus making them mass producible and inexpensive.

In the invention microfabrication techniques used for the fabrication of micro-electro-mechanical systems (MEMS) coupled with sputter deposited thin film shape memory alloy (SMA) actuation technology provide novel means of mass producing arrays of high current carrying microrelays.

BRIEF DESCRIPTION OF THE DRAWINGS

FIG. 1(*b*) is a top view of the microrelay of FIG. 1(*a*) shown in a bistable closed position.

DESCRIPTION OF THE PREFERRED EMBODIMENTS

Figure 1A:
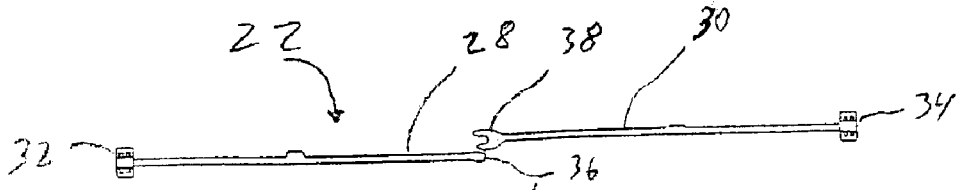
FIG. 1(*a*) is a top view of a thin film microrelay of the invention shown in a bistable open position.
Figure 1B:
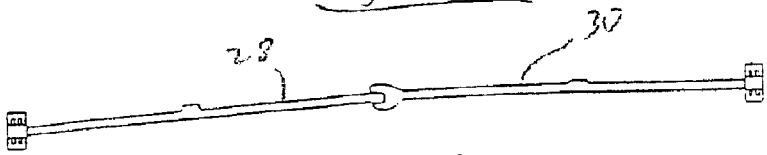
Figure 2:
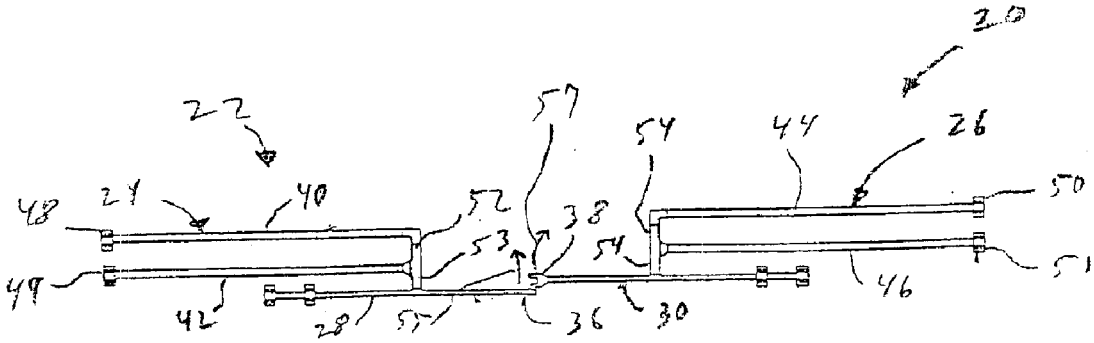
FIG. 2 is a top view of a thin film device comprising the microrelay of FIGS. 1(*a*) and (*b*) in combination with a thin film shape memory alloy actuator.

In its general concept, the invention comprises a thin film device 20 in which microrelay 22 of FIGS. 1(*a*) and 1(*b*) is in combination with shape memory alloy (SMA) actuators 24 and 26 of FIG. 2. The microrelay/actuator device 20 achieves the advantages of high work output per unit mass, small size, rapid actuation, higher efficiency than differential thermal expansion, good impedance match (operates at TTL level voltages), purely resistive impedance (no magnetic coil), and which can be fabricated using MEMS technology.

In the invention microfabrication techniques used for the fabrication of microelectro-mechanical systems (MEMS) coupled with sputter deposited thin film SMA actuation technology enable the mass production of device arrays with high current carrying microrelays. The SMA material can be made in thin film configurations in accordance with the teachings of U.S. Pat. No. 5,061,914 to Busch et. al. for Shape Memory Alloy Microactuator, the disclosure of which is incorporated by this reference.

The microrelay/actuator device of the invention provides a bi-stable latching function so that power is required only during change of state, and the relay remains unchanged if power is temporarily disrupted. Microrelay/actuator devices in accordance with the invention may be fabricated in arrays, and may be of single pole or multiple pole configuration. This leads to practical applications for protection of microelectronics components, re-direction of signals as in computer networks, and remote operation of circuits.

Microrelay 22 comprises two latching beams 28, 30 which can be of a suitable metal such as nickel. The proximal ends of the beams are secured by anchor pads 32, 34 to a substrate, not shown, such as silicon in a wafer on which the device is formed by the method steps described below under the heading Fabrication of SMA Actuated High Current Carrying Microrelays. The beams are aligned with their distal ends 36, 38 in substantial end-to-end relationship. One end 38 is forked and the other end 36 is pointed so that the two can releasably fit together in the manner shown in FIG. 1(*b*).

In the first stable position shown in FIG. 1(*a*), the two beam distal ends 36, 38 do not touch and are separated by a distance of tens of mm (typically 25 mm–50 mm). This first stable position is that of open contact. In the second stable position of FIG. 1(*b*) both of the beams are in contact and the pointed end is releasably engaged in the forked end. The beams are sized and proportioned so that they are forced against one another to slightly bent elastically, i.e. buckled together, in the second stable position. The resulting longitudinal compression force helps in producing a low ohmic resistance contact equal to a fraction of one ohm. The second stable position is that of closed contact. When it contact is closed, anchor pads 32 and 34 provide terminals for passing current through the relay beams to and from the desired external circuit, not shown.

Actuators 24 and 26 shown in FIG. 2 move respective beams ends 36 and 38 to switch the relay between its two bistable positions. The actuators are comprised of pairs of parallel bands 40, 42 and 44, 46, respectively. Each of the bands is formed of a suitable SMA material, preferably an alloy of nearly equal atomic weights of titanium and nickel, in sputter deposited thin film form. During formation, the SMA material is deposited in a naive state and is then "trained" to give it a shape memory property by annealing and prestraining. As described below in connection with the embodiment of FIGS. 6 and 7, the prestraining stretches or elongates the band from its memory shape.

For actuation, one of the bands is heated through the material's phase change transformation temperature, causing it to contract to the memory shape. Heating of the band produces a crystalline phase change transformation from martensite to austenite in the SMA material. During the phase transformation the band forcefully reverts to its memory shape to perform work in applying bending stresses to the relay beams, as described below. When cooled below the transformation temperature to a "cold state," the material of the SMA bands can be plastically deformed by elongating responsive to stress. This stress is applied from the elastic memory of the beams as they bend back toward their unstressed configurations. The high forces (relative to the small sizes in microrelays) applied by the SMA bands upon actuation enable the device to obviate problems such as stiction and other failure modes that can arise with conventional micro relays.

Anchor pads 48, 49 secure the proximal ends of the bands 40, 42 to the substrate of the device, while anchor pads 50, 51 secure the proximal ends of bands 44, 48 to the substrate. A typical substrate is shown for the embodiment of FIGS. 6 and 7. The distal ends of the bands carry strips 52, 54, respectively, of a suitable electrical conductive material which hold the ends apart while also completing the path of current flow between the bands during actuation. Pads 53, 54 of a suitable current insulating material, such as SU-8 resist material as explained for the embodiment of FIG. 5, connect the band ends to mid-portions of respective beams 28, 30.

Actuation is accomplished by operation of a suitable controller circuit, which can be a part of a computer system, to pass electric current selectively through the actuator bands. The anchor pads for the bands serve as terminals for the current flow. Current density would be modulated sufficient to heat the SMA material of the selected bands through the phase change transition temperature. This effects a phase change of the material from martensite to austenite, causing the actuator bands to contract as explained above. The contraction of actuator 24 creates a force couple on beam 28 which bends its end 36 up in the direction of arrow 55 (FIG. 2), while contraction of actuator 26 creates a force couple on beam 30 which bends its end 38 up in the direction of arrow 57.

Starting from the open contact position of in FIG. 2, the closed contact position is effected by the controller simultaneously heating and actuating the pair of bands 40 and 42 of actuator 22. As both bands contract, left beam 28 bends up until pointed end 36 slips into engagement with forked end 38 of right beam 30. During this actuation, the opposing pair of bands 44 and 46 for actuator 26 are in their cold states and thus deactivated. The control circuit then shuts off current flow so that both actuators are deactivated. Deactivation of SMA bands 40 and 42 enables them to be cooled by conduction and convection to below the transition temperature so that the beams can bend by their elastic memory back toward their initial configurations. Because their ends are engaged, this causes the two beams to slightly curve into a buckling mode. An important feature of the invention is that in the buckling mode, when there is no applied current, the force holding the beam ends together is greater than the force required to engage them. This enables the ends to hold themselves together in a stable position without the need to apply any external forces.

Starting from the closed contact position shown in FIG. 1(*b*), the open contact position is effected by the controller simultaneously actuating the pair of bands 44 and 46 of actuator 24 so that both contract and bend right beam 30 up sufficient to move end 38 out of engagement from end 36. During this actuation, bands bands 40 and 42 of actuator 24 are deactivated. After the ends are disengaged, the control circuit shuts off current flow so that both actuators are deactivated.

Alternatively, the closed contact position could be effected by positioning pointed end 36 above forked end 38 and then energizing actuator 20 to bend right beam 30 up. The open contact position can then be effected by energizing actuator 24 to move left beam 28 up.

It will be seen that the actuation current is supplied only during the change of state, i.e. during engaging or disengaging of the actuator beams. Low TTL compatible voltages less then 5V and currents of a few mA are used for actuation. The power requirement is in the range of one hundred milliwatts.

Figure 3:
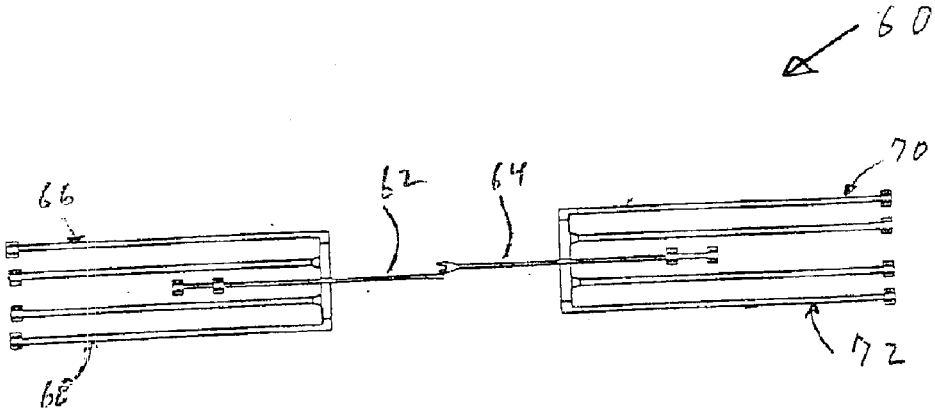
FIG. 3 is a top view of the microrelay of FIGS. 1(*a*) and (*b*) in combination with another embodiment of an actuator.

FIG. 3 shows an embodiment providing a shape memory alloy actuated microrelay device 60 in which each relay beam 62, 64 is operated by pairs of SMA actuators 66, 68 and 70, 72 to engage and disengage the beam ends.

Figure 4:
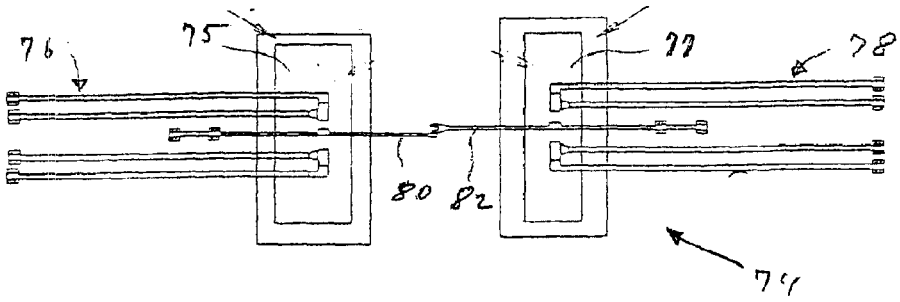
FIG. 4 is a top view of the microrelay of FIGS. 1(*a*) and (*b*) in combination with another embodiment of an actuator.

FIG. 4 shows an embodiment providing a shape memory alloy actuated microrelay device 74 which comprises silicon islands 75 and 77 to separate the actuation circuit for the SMA bands of actuators 76, 78 from the high current switching circuit for the microrelay beams 80, 82. At the same time, connection is maintained between the beams and the SMA actuators so that when the SMA bands contract, the force of actuation is passed on via the silicon island to the nickel beams (anchored to the island) to engage them or disengage them.

Figure 5:
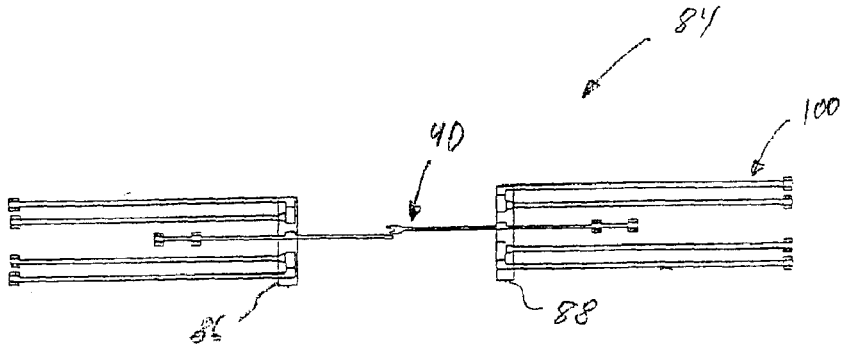
FIG. 5 is a top view of the microrelay of FIGS. 1(*a*) and (*b*) in combination with another embodiment of an actuator.

FIG. 5 shows an embodiment providing microrelay device 84 comprising strips 86, 88 of SU-8 resist material positioned between the relay beams 90 and SMA bands 100. The strips are electric insulators and act as circuit separators between the beams and SMA bands, while at the same time transmitting actuation forces from the bands to the beams.

Figure 6:
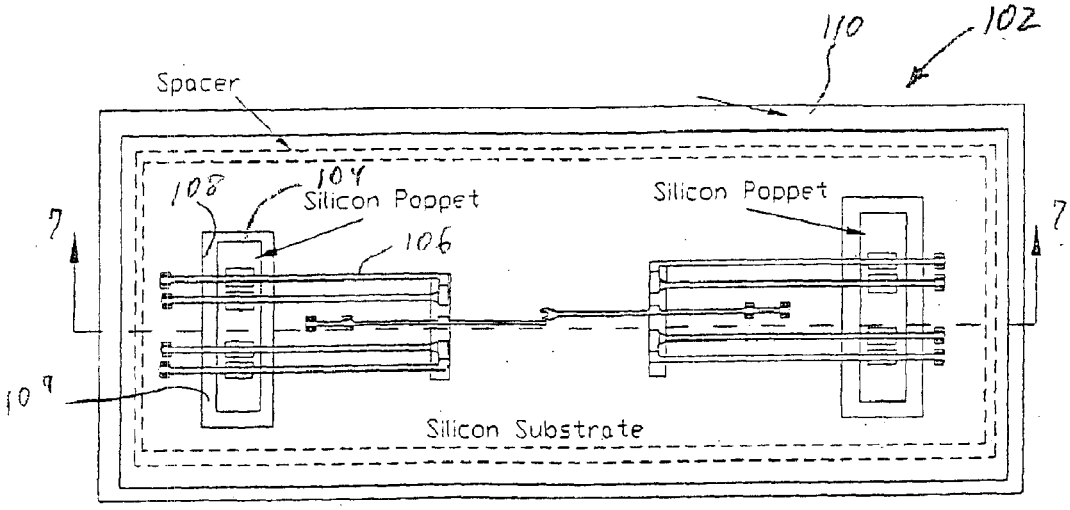
FIG. 6 is a top view of the microrelay of FIGS. 1(*a*) and (*b*) in combination with an actuator in accordance with another embodiment.
Figure 7:
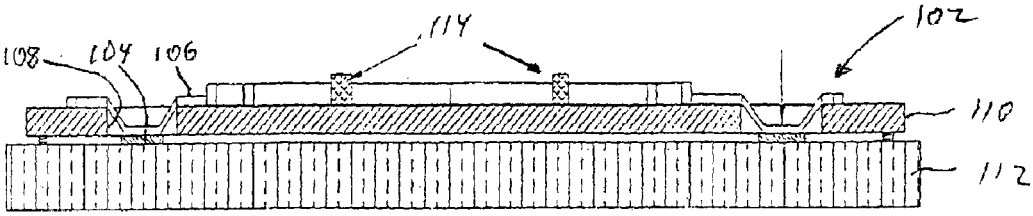
FIG. 7 is a cross-sectional view taken along the line 7—7 of FIG. 6.

FIGS. 6 and 7 show an embodiment providing microrelay device 102 comprising silicon poppets 104 with SMA bands 106 anchored onto them. The poppets are centered in space-apart relationship within cavities 108 formed in silicon substrate 110, which in turn is mounted above a ceramic substrate 112. These poppets are depressed down in the cavities 109 to pre-strain the SMA bands. SU-8 resist material 114 (or silicon islands) is used for the separation of circuits as shown in FIGS. 4 to 5.

Figure 8:
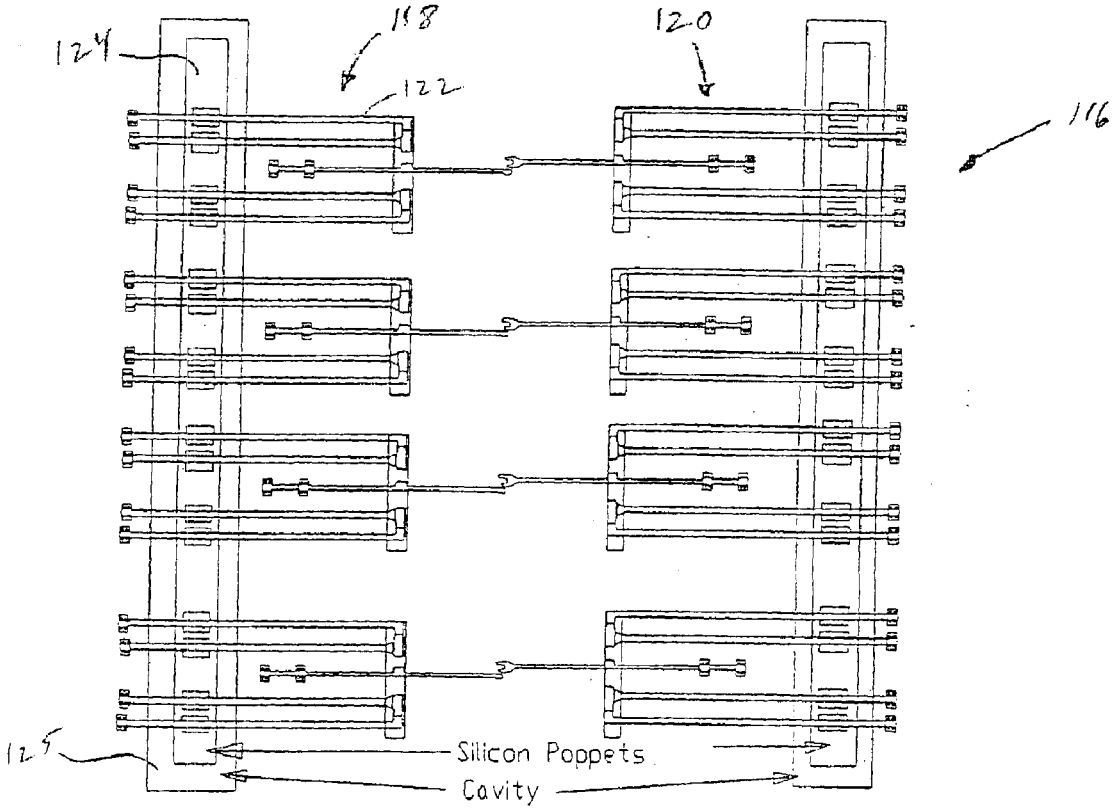
FIG. 8 is a top view of an array of multiple microrelays and actuators in accordance with another embodiment of the invention.

FIG. 8 shows an embodiment providing microrelay device 116 comprising a silicon die with an array of microrelays 118, 120. The SMA bands 122 are anchored to silicon poppets 124 and pre-strained as described for FIG. 6 by depressing the poppets down by adhering them to a ceramic package underneath (not shown) separated from the substrate with a spacer.

Figure 9:
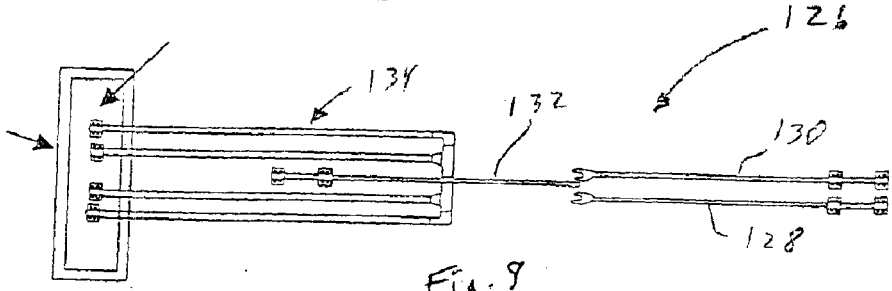
FIG. 9 is a top view of a single pole double throw bi-stable microrelay and actuator in accordance with the invention.

FIG. 9 shows an embodiment providing microrelay device 126 comprising a pair of forked-end beams 128, 130 and a single pointed-end beam 132 which are operated by SMA actuator 134 to provide a single pole double throw bi-stable shape memory alloy actuated microrelay.

Figure 10:
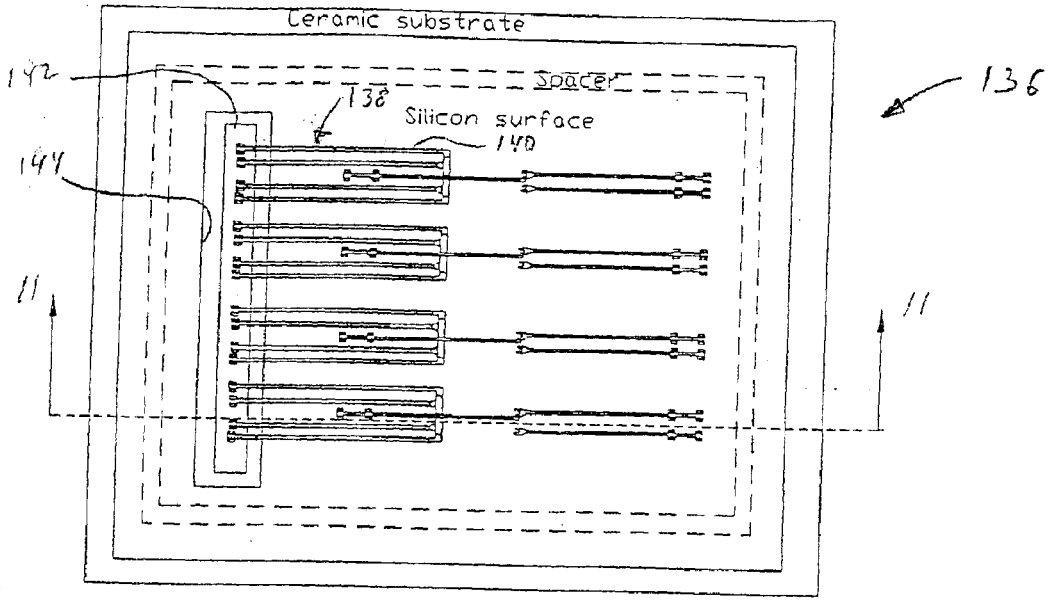
FIG. 10 is a top view of an array of multiple single pole double throw bi-stable microrelays and actuators in accordance with another embodiment.
Figure 11:
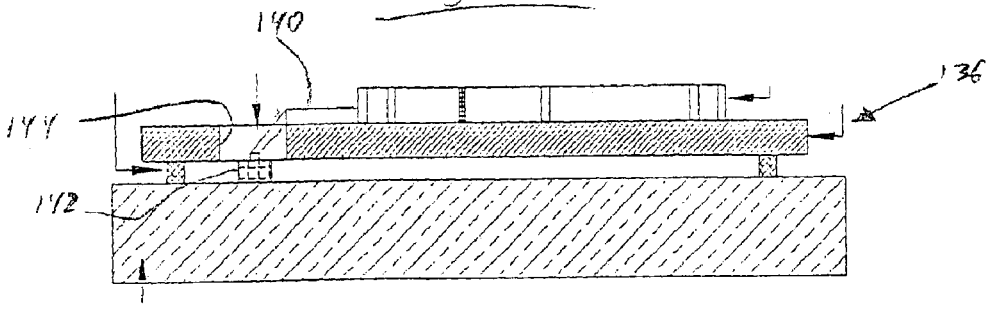
FIG. 11 is a cross-sectional view taken along the line 11—11 of FIG. 10.

FIGS. 10 and 11 show an embodiment providing microrelay device 136 comprising a plurality of the single pole double throw microrelay as described for FIG. 9 with SMA actuators 138 having pre-strained bands 140. The bands are pre-strained by depressing the free-standing silicon poppets 142 (attached to the SMA bands as shown) in the cavity 144 below them.

Figure 12:
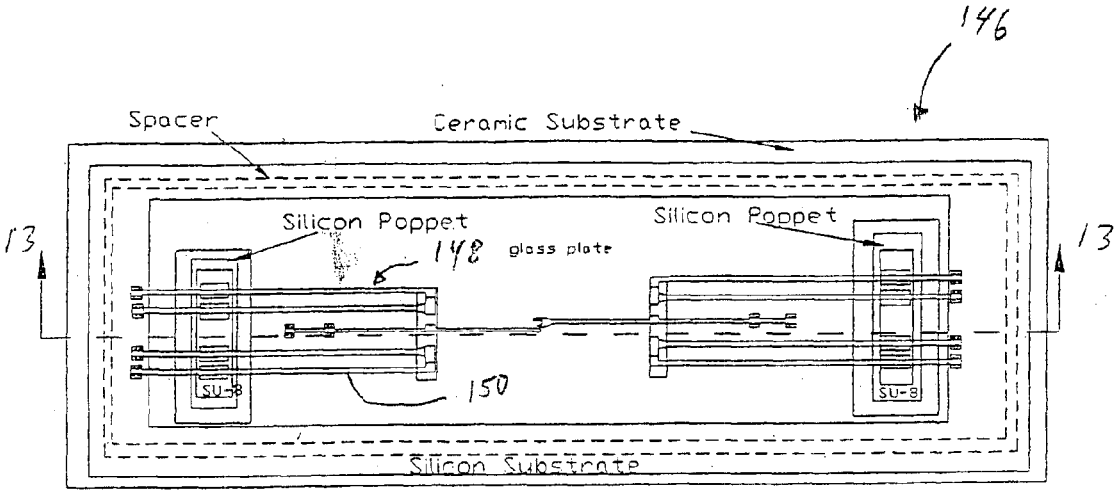
FIG. 12 is a top view of the microrelay FIG. 6 showing prestressing of the SMA bands.
Figure 13:
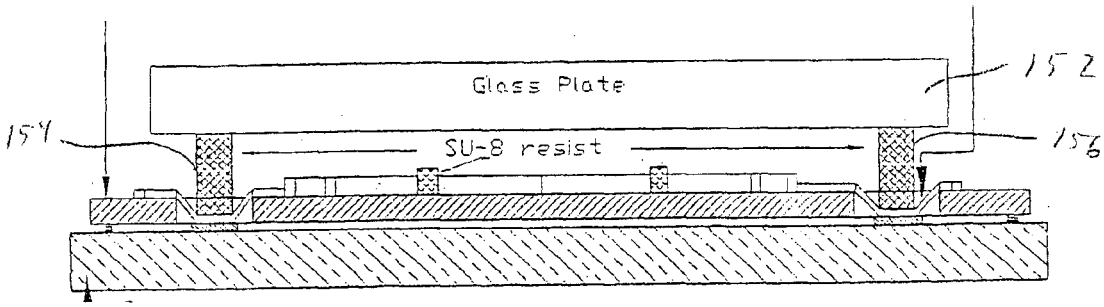
FIG. 13 is a cross-sectional view taken along the line 13-3 of FIG. 12.

FIGS. 12 and 13 show an embodiment providing microrelay device 146 comprising actuators 148 having SMA bands 150 which are pre-strained by means of a glass plate 152. The plate is patterned with SU-8 resist pads 154, 156 between the plate and top of the bands.

Fabrication of SMA Actuated High Current Carrying Microrelays

Figure 14:
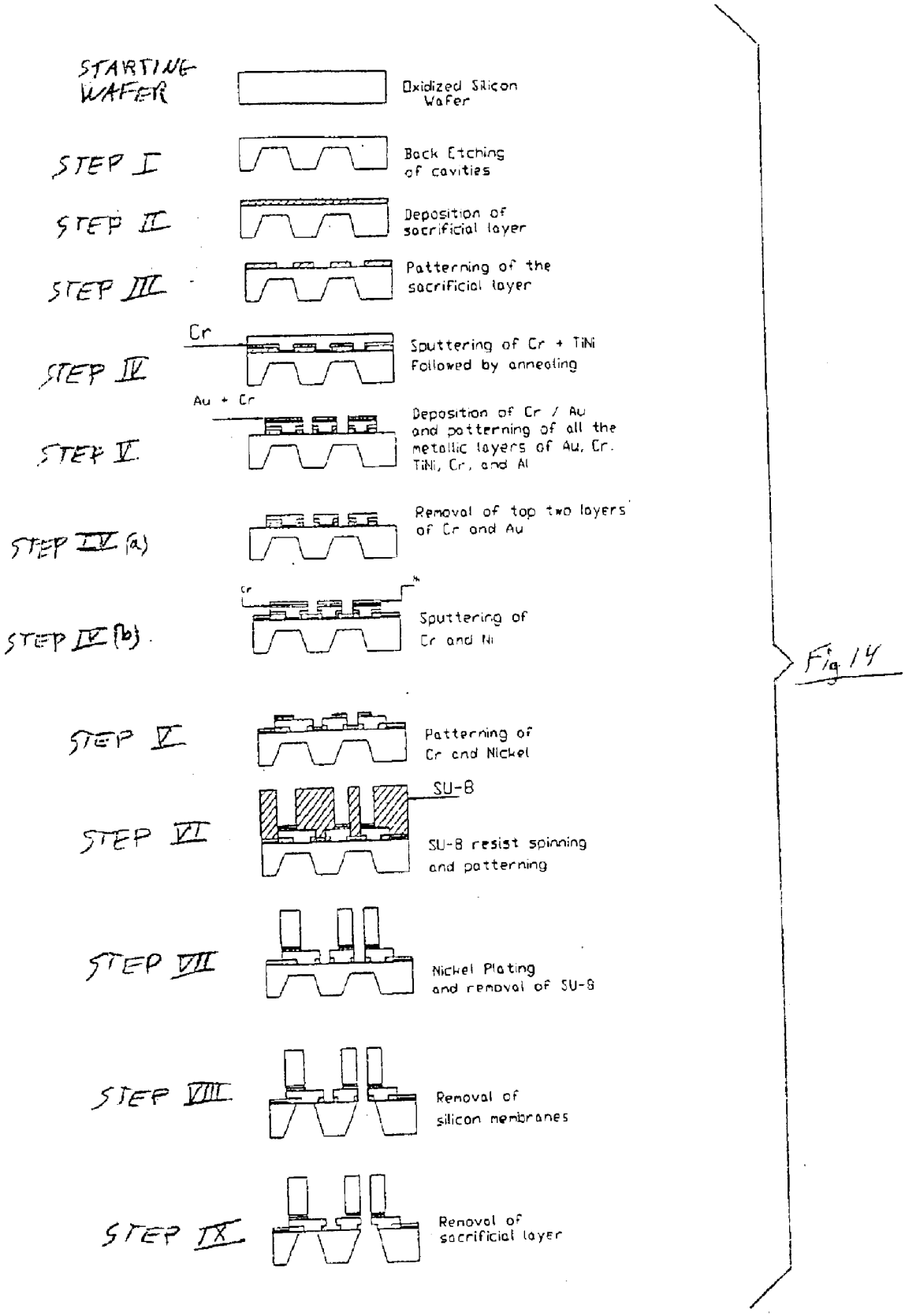
FIG. 14 is a flow chart showing the method steps in the fabrication of the microrelay and actuator combinations of the invention.

FIG. 14 illustrates the steps in the method of forming the SMA actuated microrelays in the invention. Substrates with sizes varying from the smallest diameter commercially available to the largest diameter can be used.

STEP I: The wafer is back etched partially using a conventional potassium hydroxide wet etching bath or deep reactive ion etching (DRIE) to create silicon poppets.

STEP II: A thin sacrificial layer of aluminum is evaporated on the front side of the wafer. A sacrificial layer of other metals like copper can also be used if they can be etched without damaging the SMA, which is TINI, and Ni. The sacrificial layer is patterned to create anchors.

STEP III: A thin film of chrome (0.03 mm thick) followed by a film of TiNi 3–5 mm thick is sputter deposited onto the wafer in a Perkin-Elmer 4400 machine. The whole assembly is placed in a vacuum chamber for annealing at 500° C.

STEPS IV(a) and IV(b): A layer of chrome (200 Å thick) followed by 0.1 mm thick layer of gold is evaporated on top of the above assembly. This layer of chrome acts as an adhesion layer between gold and TiNi. The films of gold, chromium, TiNi, chromium, and aluminum (in that order) are lithographically patterned using a chemical etch process to create microrelays. The two top layers of gold and chrome are etched away with chemical etchants.

STEP V: Chromium and nickel are sputtered onto the wafer and lithographically patterned using a chemical etch process.

STEP VI: Thick resist SU-8 is spun on the wafer and patterned lithographically to create cavities.

STEP VII: Nickel is electroplated in these cavities to fabricate thick nickel beams. The thickness of these beams is in excess of 60 mm. SU-8 resist is removed.

STEP VIII: The wafer is back etched all the way to fabricate free standing poppets attached only to TiNi microribbons.

STEP IX: The wafer is put in a chemical etchant to etch the sacrificial layer of aluminum.

STEP X: The wafer is taken out of the chamber and diced. At this point it is ready for testing, assembly, and packaging.

In STEP III a thin layer (sub-micron thick) of chrome (or another metal with a high melting point and low diffusivity that can be etched sacrificially to TiNi) is sputtered on top of aluminum before sputtering TiNi. This layer of chromium acts as a barrier for aluminum atoms to prevent them from diffusing in TiNi when annealing at temperature of 500° C. is carried out. In the absence of a chrome layer, the aluminum will diffuse in TiNi and severely damage the SMA property of TiNi.

A modification possible in the above set of processes is the use of a thick resist other then SU-8 in STEP VI. A resist that can be spun or pressed on top of a wafer and lithographically patterned or ion-milled can be used. Resists like PMMA can also be used and patterned to create deep cavities for plating in nickel beams.

Alternatively another material like nickel-iron alloy or some other metal instead of nickel can be electroplated in STEP VII. The material should have a high spring constant, low wear rate and high hardness characteristics, low resistivity, and it should be easy to plate.

Another modification that can be made is to eliminate STEP I altogether. Free standing silicon poppets can be created using Deep Reactive Ion Etching (DRIE) in STEP VIII after the SU-8 resist has been removed.

The invention contemplates a microrelay in which each of the nickel beams can be actuated in two different directions. Depending on which SMA band has been actuated, the beams can be engaged or disengaged.

Circuit Separation

The actuation circuit of the SMA bands and high current carrying nickel beam circuit should be separated to avoid failure of the microrelays. The two circuits can be separated using a layer of silicon nitride between the nickel beams and SMA bands. This layer of silicon nitride can be sputter deposited or chemically vapor deposited right after STEP III. Following deposition this layer of silicon nitride can be patterned using a mask, resist and SF6 plasma in a barrel etcher. The layer is patterned such that it is present only on top of the beams component of the microrelay, where nickel is to be plated.

In another contemplated form of the invention, the nickel beams are totally separated from the SMA bands. Both the parts of the nickel beams and the SMA bands are anchored on top of the free-standing silicon poppet islands as shown in FIG. 4. This island of silicon is fabricated by creating windows in the silicon oxide layer on the back side of silicon substrate. Wet etching techniques like a KOH bath can be used for back etching or alternatively DRIE can also be used to create free-standing islands of silicon. Actuation of SMA bands causes the island to deflect and it passes on the actuation force to the nickel beams that engage or disengage with the complementary nickel beam.

Alternatively, SU-8 resist can be used as a structural material after hard baking it above a temperature of 150° C. as shown in FIG. 5. SU-8 can be spun on top of a wafer and lithographically patterned to create features that provide an insulating link between nickel beams and TiNi micro-ribbon actuators to pass on the actuation force.

Pre-Straining Mechanism for SMA Bands

The following mechanism is appropriate for the pre-straining described in connection with the embodiments of FIGS. 6–7, FIGS. 8–9, and FIGS. 12–13. The SMA bands are attached to the free-standing silicon poppet. The poppet is depressed into the cavities from the top using a substrate with protruded features like thick SU-8 resist features on a glass substrate as shown in FIGS. 12–13.

The poppets can also be simply bonded to a second substrate below (that is separated from the first substrate with a thin spacer) during assembly and in the process it pre-strains the SMA bands as is shown in FIG. 6. In some cases, as shown in FIGS. 10–11, the free-standing poppet is attached to SMA bands of multiple relays. During assembly, this poppet is depressed and stuck to a another substrate like a ceramic substrate separated by a spacer from the silicon substrate, to pre-strain multiple SMA bands.

While the foregoing embodiments are at present considered to be preferred, it is understood that numerous variations and modifications may be made therein by those skilled in the art and it is intended that the invention includes all such variations and modifications that fall within the true spirit and scope of the invention as set forth in the appended claims.

What is claimed is:

1. A microrelay device for opening and closing a current path between first and second terminals that are carried on a substrate, the device comprising the combination of:

first and second electrically conducting latching beams, the first beam having a distal end together with a proximal end electrically connected with the first terminal, the second beam having a distal end together with a proximal end electrically connected with the second terminal, the first beam being sufficiently elastic to enable it to bend responsive to a bending force from a first configuration at which the distal ends are unlatched toward a second configuration at which the first beam is curved and the distal ends are latched, the distal ends when unlatched being spaced apart sufficient to open the current path between the first and second terminals, the distal ends when latched being in electrical contact to close the current path, and an actuator for applying the bending force to the first beam.

2. A microrelay device as in claim 1 and further characterized in that the second beam is in a first configuration when the distal ends are latched, the second beam being sufficiently elastic to enable it to bend responsive to an other bending force from its first configuration to a second configuration at which the distal ends are unlatched, and an other actuator for applying the other bending force to the second beam.

3. A microrelay device as in claim 1 in which the first configuration is in a curve which causes the first and second beams to buckle together with a closure force between the beams that is sufficient to releasably hold the distal ends in the latched position.

4. A microrelay device as in claim 3 in which the closure force is independent of the bending force.

5. A microrelay device as in claim 1 in which the distal ends comprise complementary respective shapes which interfit in releasable engagement when latched.

6. A microrelay device as in claim 1 in which the actuator comprises a thin film band of shape memory alloy material which undergoes crystalline phase change when heated through the material's phase change transition temperature sufficient to cause the band to deform from a first shape to a memory shape, the band being coupled with the first beam and applying said bending force responsive to said deformation to the memory shape.

7. A microrelay device as in claim 6 in which the band in the first shape is stretched under a tension prestress, and the deformation is by axial contraction to the memory shape.

8. A microrelay device as in claim 2 in which the other actuator comprises an other thin film band of shape memory alloy material which undergoes crystalline phase change when heated through the material's phase change transition temperature causing the band to deform from a first shape to an other memory shape, the band being coupled with the second beam and applying said other bending force responsive to said deformation to the other memory shape.

9. A microrelay device as in claim 8 in which the other band in the first shape is stretched under a tension prestress, and the deformation is by axial contraction to the memory shape.

10. A microrelay device as in claim 6 in which the band is comprised of a pair of parallel spaced-apart segments having proximal ends anchored to the substrate with the distal ends of the bands being electrically coupled together and coupled with a portion of the first beam spaced from its proximal end, said band segments having a memory shape which causes them to undergo said deformation by contraction, and the band segments being oriented along a direction parallel with the first beam so that said contraction causes the band segments to exert a pulling on said portion of the first beam to apply said bending force.

* * * * *

UNITED STATES PATENT AND TRADEMARK OFFICE

CERTIFICATE OF CORRECTION

PATENT NO. : 7,084,726 B2
APPLICATION NO. : 10/661035
DATED : August 1, 2006
INVENTOR(S) : A. David Johnson et al.

It is certified that error appears in the above-identified patent and that said Letters Patent is hereby corrected as shown below:

Cover Page, item:
(75) Inventors should read: A. David Johnson, San Leandro, CA (US)
Vikas Galhotra, Union City, CA (India)
Vikas Gupta, San Leandro, CA (India )
Valery Martynov, San Francisco, CA (US)

Signed and Sealed this

Twenty-eighth Day of November, 2006

JON W. DUDAS
*Director of the United States Patent and Trademark Office*